US005120402A

United States Patent [19]

Reiter

[11] Patent Number: 5,120,402

[45] Date of Patent: Jun. 9, 1992

[54] EXPANSION MEMBER, PARTICULARLY FOR THE BREAST BOX OF A PAPER MACHINE

[75] Inventor: Walter Reiter, Heidenheim, Fed. Rep. of Germany

[73] Assignee: J.M. Voith GmbH, Fed. Rep. of Germany

[21] Appl. No.: 714,008

[22] Filed: Jun. 5, 1991

[30] Foreign Application Priority Data

Jun. 6, 1990 [DE] Fed. Rep. of Germany ..... 4018054

[51] Int. Cl.[5] ..... D21F 1/02

[52] U.S. Cl. ..... 162/336; 162/344; 162/347

[58] Field of Search ..... 162/289, 336, 344, 347, 162/352; 248/180, 631, 638, 654; 425/381, 466

[56] References Cited

U.S. PATENT DOCUMENTS 2,928,464 3/1960 Western et al. ..... 162/344
4,867,847 9/1989 Kade ..... 162/344
4,877,486 10/1989 Kade et al. ..... 162/344
4,980,026 12/1990 Kade ..... 162/344

*Primary Examiner*—Karen M. Hastings
*Attorney, Agent, or Firm*—Ostrolenk, Faber, Gerb & Soffen

[57] ABSTRACT

An expansion member which extends transversely over the width of a paper making machine, particularly at the breast box of the paper machine, which member furthermore serves to change the position of a structural part, like a ledge or diaphragm. The member is subdivided, transverse to the machine direction, into a plurality of cells each of which can be acted on by pressure. The cells are separated from each other by vertical partition walls of high stretchability and are further defined by transverse walls extending transverse to the machine direction and joining the partition walls. At least one transverse wall or a further wall outside of and connected with the one transverse wall is highly stretchable in the regions of the transverse or further walls which are at the individual partition walls, as compared with the other regions of the transverse wall or the thereto connected further wall.

17 Claims, 4 Drawing Sheets

EXPANSION MEMBER, PARTICULARLY FOR THE BREAST BOX OF A PAPER MACHINE

BACKGROUND OF THE INVENTION

The present invention relates to an expansion member for use on a paper making machine and particularly located at the breast box of the machine.

A paper making machine has a breast box including an outlet slot from which the fiber suspension is sprayed. The outlet slot extends over the cross machine width of the machine. To adjust the height of the outlet slot between the two lips of the slot, an expansion chamber is disposed on at least one lip, and controlled expansion of the chamber bends the lip and determines the slot height. There are also other applications for an expansion chamber in a paper making machine.

Such an expansion member is known from Federal Republic of Germany Published Application DE 37 28 387 A 1, equivalent to U.S. Pat. No. 4,867,847. In that case, the expansion member is essentially a hollow beam including pressurizable, expansible cable. The beam includes a plurality of separate pressurizable cells over its length in the cross machine direction. The cells, which can be individually acted on by pressure, have a box profile, as seen in a cross section transverse to the machine direction and perpendicular to the fiber web. The partition walls between two adjacent cells are highly stretchable, and these partition walls can increase in length upon a corresponding change of the internal pressure within one cell, as compared with the pressure in the neighboring cell. The side partition walls are joined by an upper transverse wall above the cell and a lower transverse wall below the cell. The upper transverse wall rests against a firm surface. The lower transverse wall, which is effectively the bottom of the cell, must move perpendicular to the fiber web moving out of the outlet slot of the breast box. If the expansion member is placed in the vicinity of the outlet slot or outlet channel from the breast box, then the slot or channel height or cross section is narrowed by movement of the bottom of the cell in the direction toward the fiber web passing out the outlet slot.

The purpose of the above described known device is to act directly on the weight per unit area profile of the material moving out the slot or channel at very specific points transverse to the machine direction. To do this, individual cells are acted on with pressures of different value. It has been found that it is not possible precisely to locally limit the influence on the height of the outlet slot and thus the weight per unit area, as would be desired. Instead, the pressure which is applied to a single cell acts, as seen transversely to the machine direction, also beyond the length of that cell, i.e. it also acts on the neighboring cells. This may be undesirable in a specific case.

The inventor here has found the following to be the cause of this problem. If a cell in a coherent box profile is acted on by pressure, then not only do the side or partition walls which define this cell lengthen, but the adjacent partition walls of the neighboring cells are also affected to a greater or lesser extent and thus they are also lengthened, so that a change in cross section of the outlet channel, which can be delimited precisely in zonewise fashion with respect to each cell, is not possible.

SUMMARY OF THE INVENTION

The object of the invention is to provide an expansion member such that the effect of the action of pressure on a given cell remains limited, as seen transverse to the machine direction, substantially to that transverse region over which the cell extends.

The present invention concerns an expansion member which extends transversely over the width of a machine for manufacturing fiber webs and particularly a paper making machine. The expansion member is particularly useful at the breast box of a paper making machine, although it need not be placed there and may be used in other applications in the machine. The expansion member is operable to change the position of a structural part of the machine, e.g. a ledge or a diaphragm, or the like.

The expansion member is subdivided transverse to the machine direction into a plurality of cells. Each cell is individually connectable to a pressure source so as to be separately pressurizable.

Each cell is separated from the neighboring cells by upstanding opposite side partition walls, which extend up away from the slot and in the longitudinal or machine or suspension flow direction. There may be respective side partition walls at and for each cell so that adjacent partition walls of neighboring cells abut. The partition walls between neighboring cells are highly stretchable.

Joining the two partition walls of each cell and defining and surrounding the cell are two transverse walls which extend transversely of the machine direction and also extend in the length direction. All of the partition walls and the transverse walls of each cell extend in the longitudinal machine direction over the length of the respective cells. At least one of the transverse walls, and usually the transverse wall that is toward the outlet slot of the breast box where the expansion member is used at a breast box, is comprised of more highly stretchable material in the regions of the transverse walls that are at the partition walls between neighboring cells and is comprised of less stretchable material, perhaps even rigid material, in the other regions of the transverse walls, which include those regions that are along the transverse walls and not at the partition walls.

Either the one enclosing transverse wall of the cell itself defines the above described regions of more and less stretchability or there is a further wall outside of and resting against the one transverse wall of each of the cells, such that the transverse walls of each of the cells are uniformly stretchable but the adjacent further wall has the regions of more and less stretchability which are placed at the cells as described above.

The transverse wall or further wall regions of greater and lesser stretchability are comprised either of respective separate ledges which together define the wall or, in a second embodiment, the entire further wall or an entire transverse wall for all of the cells is formed of a cross machine length of highly stretchable material in which are embedded spaced apart beams or widths of less stretchable material which define the less stretchable sections.

In all embodiments, the less stretchable and more stretchable sections alternate across the machine direction.

In the present invention, at least one transverse wall region in the region of the individual partition walls is made highly stretchable. That transverse wall region is much softer and yieldable, at least in that region in which a partition wall meets it, than the other regions of that transverse wall.

When it is applied to the breast box of a paper making machine, the above described expansion member could be developed and arranged as follows. It extends transversely to the machine direction, either in the outermost or downstream lip region as part of the upper lip of the outlet channel or somewhat further upstream. Therefore, as seen in the direction of pulp suspension flow, it is somewhere within an intermediate region of the outlet channel. The upper transverse wall of the expansion member rests against a fixed, practically unyieldable wall. The lower transverse wall of the expansion member, on the other hand, is part of the flow guiding wall of the upper lip of the outlet channel. In this connection, the upper lip can be contacted directly by the flow and thus the lip shape limits the outlet channel over a part of its length, as seen in the transverse or cross machine direction.

The lower transverse wall of the expansion member can be considered to be divided into a plurality of individual partial walls which limit the individual cells on their bottom side and are connected to each other at their places of abutment by a highly elastic, highly stretchable material. If increased pressure is applied in an individual cell, the lower partial transverse wall of this cell can expand downward in the direction toward the flow channel without the adjacent regions of the lower transverse walls of adjacent cells participating in such movement. In this way, a change in the channel height can be precisely limited locally.

As stated above, the lower transverse wall can form a limiting wall of the outlet channel and thus can be contacted by the flow. This, however, need not be the case. The lower transverse wall can also carry outside of it and have in contact with it a further wall which, in its turn, forms a limiting surface or lip of the outlet channel and is contacted by the flow. Such a further wall would then be developed according to the invention, i.e. it would have very little transverse stiffness, at the least at various above described regions along the cross machine width. The transverse stiffness of the further wall, or if there is no further wall, then the transverse wall, as a whole is best kept extremely small, while its longitudinal stiffness in the machine direction can be substantially greater. The ratio between transverse stiffness and longitudinal stiffness should be at least 1:10, and preferably 1:100, or even more. The greater is that ratio, the more precisely the width of the outlet channel can be adjusted zonewise.

It is also possible to provide, below the lower transverse wall which faces the outlet channel, a foil which extends over the entire width of the machine and which bridges over the individual joints between the cells.

Other objects and features of the invention are explained below with reference to the drawings.

DESCRIPTION OF A PREFERRED EMBODIMENT

Figure 1:
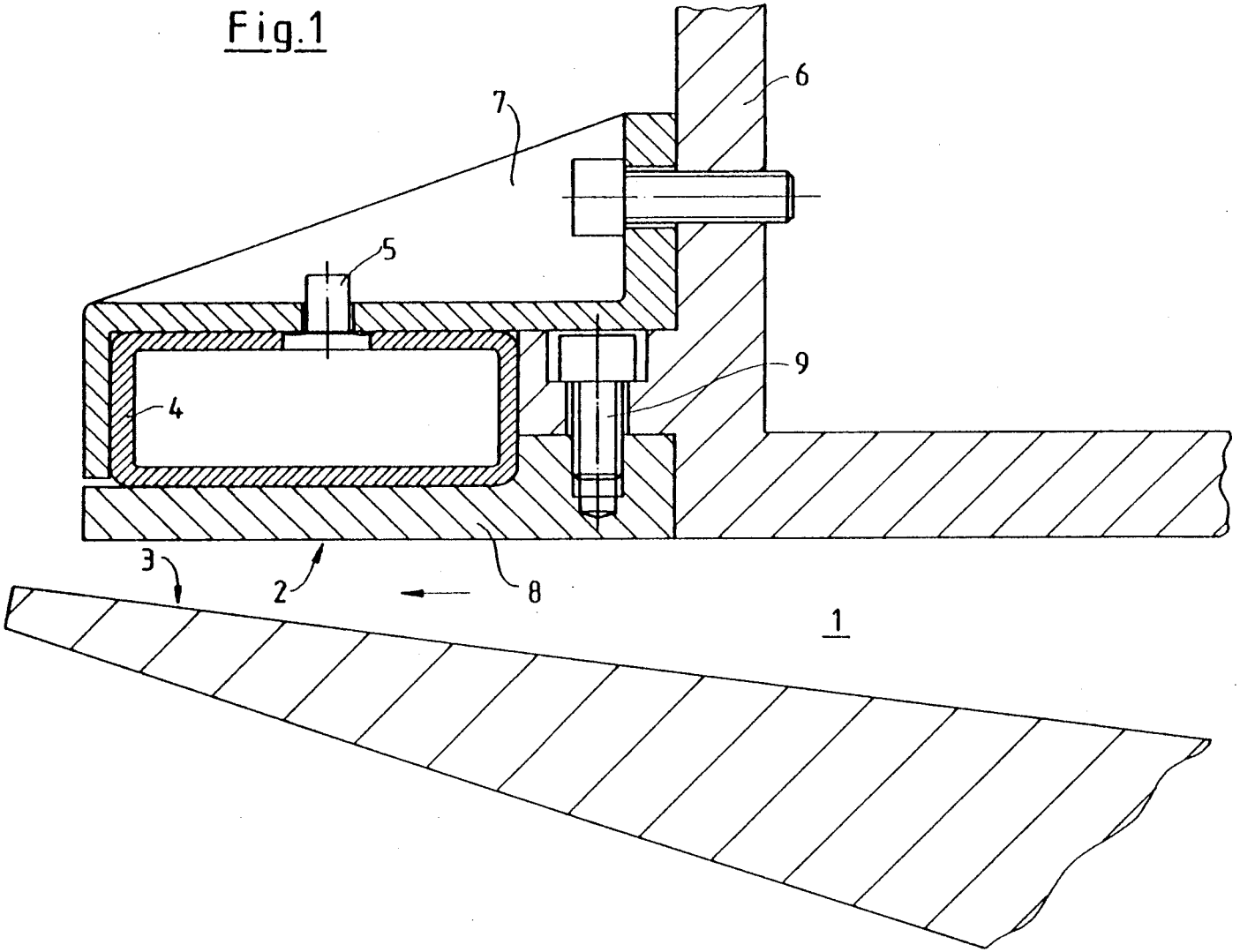
FIG. 1 shows a longitudinal section of a flow channel of a breast box together with the adjoining components, and having an expansion member arranged in the outlet region.

The breast box shown in FIG. 1 has an outlet channel 1 with a height that is defined by an upper lip 2 and a lower lip 3. The lower lip 3 is substantially stiff. The upper lip 2 is slightly bendable down toward the lower lip at selected regions thereof along the cross machine direction.

An expansion member 4 is above the upper lip for locally deforming it. The member 4 extends substantially over the entire cross machine work width of the paper making machine. The expansion member is in the form of a hollow beam. The hollow beam is divided along the cross machine direction into a plurality of cells 30, et seq., each having its own compressed air pressurizable connection 5.

The breast box has a front or downstream wall 6. That wall supports a rigid bracket 7 in front of it. Beneath the lower region of the expansion member 4, there is a ledge 8. The rear or upstream end of that ledge is fastened by screws 9 to the front wall 6 of the breast box, as seen in the direction of flow. The ledge 8 forms the actual upper lip 2, and its shape will be described further below. If pressure is applied to the individual cells via the respective pressure connections 5, these cells apply themselves at their top walls against the rigid bracket 7, and at their lower walls against the upper lip 8 of the breast box.

Figure 2:
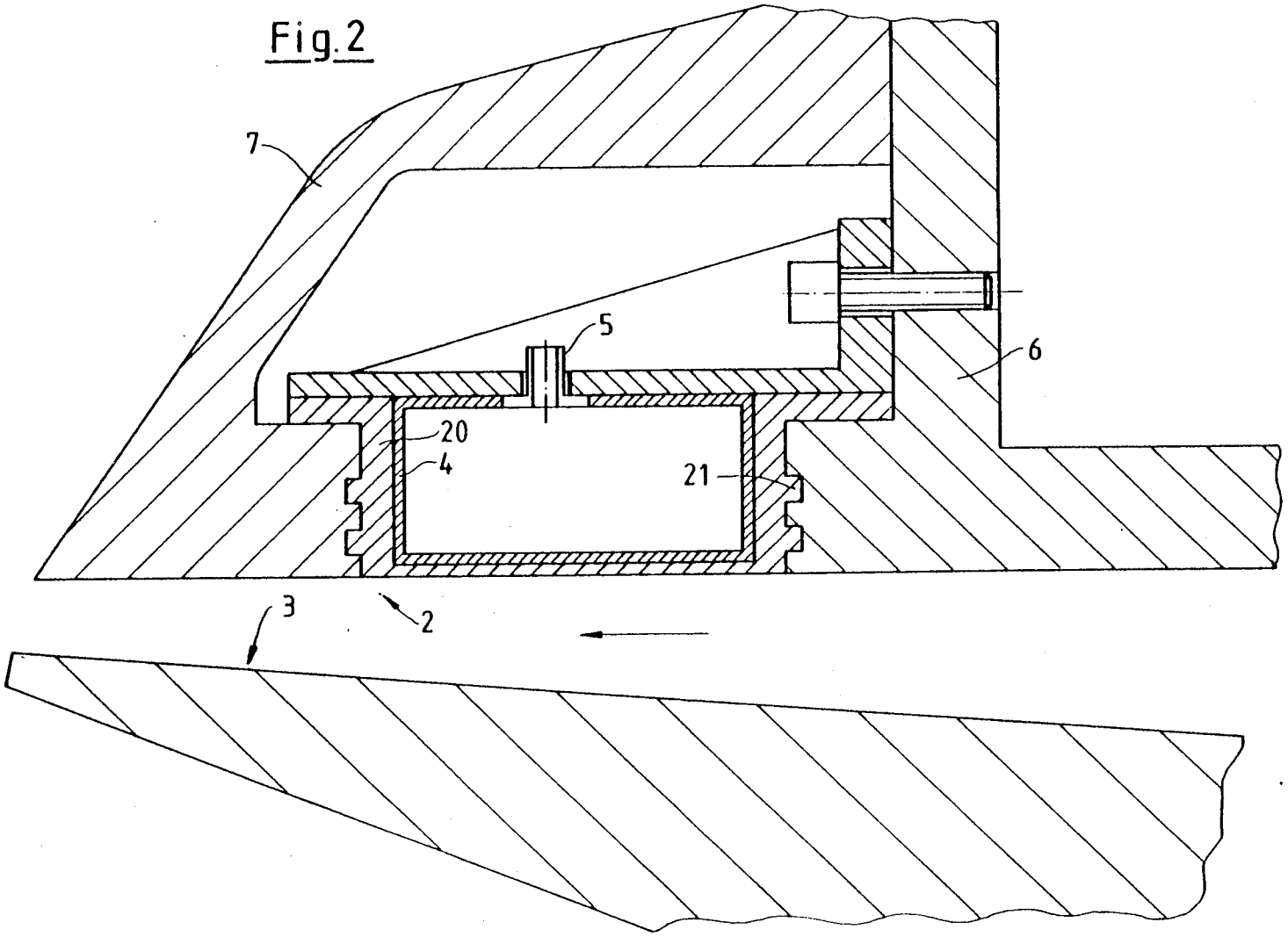
FIG. 2 shows a view similar to FIG. 1, with the expansion member arranged somewhat further upstream.

The embodiment in accordance with FIG. 2 has the same principle as the embodiment in FIG. 1. However, in this case the expansion member 4 is arranged somewhat further upstream from the outlet exit. Further, the member 4 is contained within a box 20. That box is connected in a form locked manner to the front wall 6 of the breast box and to the rigid bracket 7 by a toothed connection 21.

Figure 3:
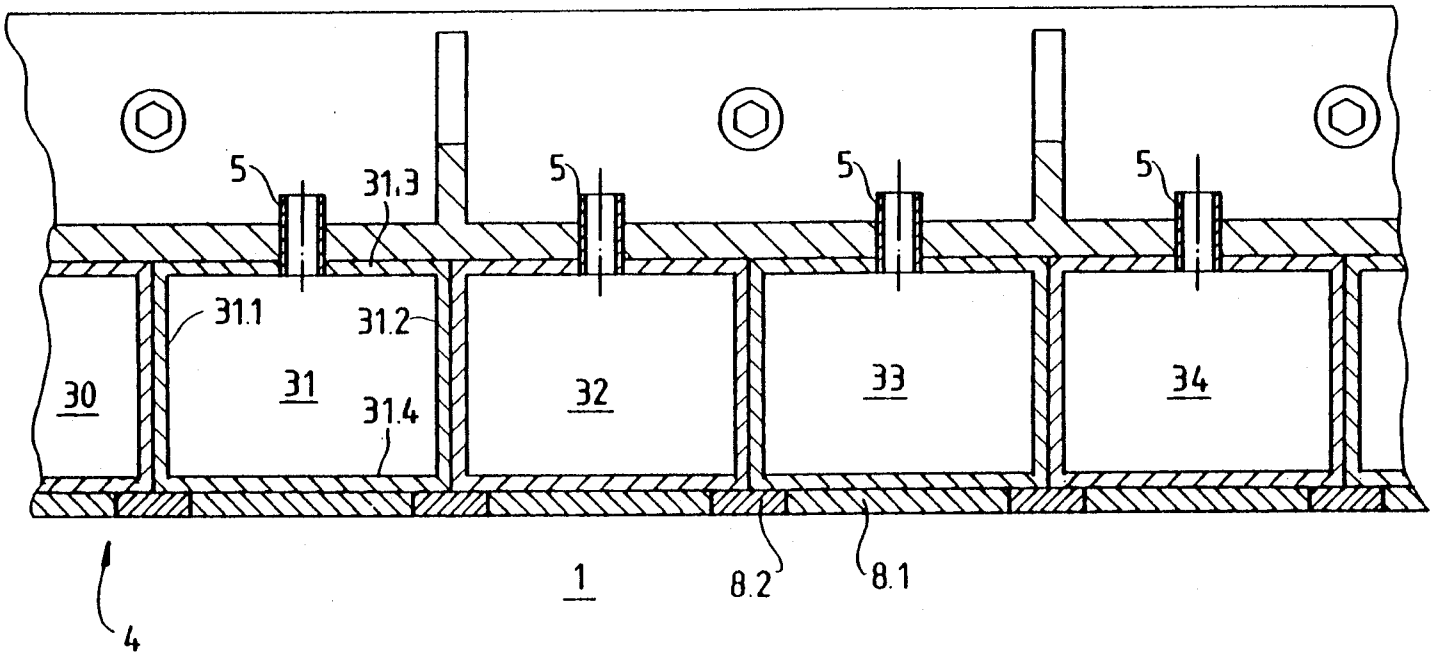
FIG. 3 is a transverse section perpendicular to the machine direction and to the outlet channel, showing individual cells formed by their own walls.
Figure 5:
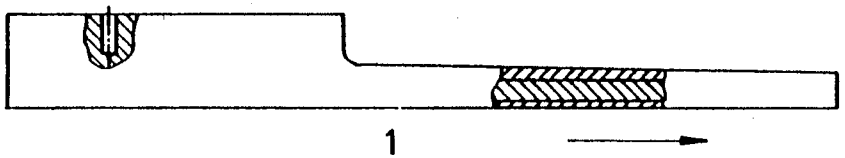
FIGS. 4, 5 and 6 show an upper lip of a breast box developed in accordance with the invention, with FIG. 4 showing it in a section perpendicular to the machine direction and to the flow of pulp, FIG. 5 showing a perpendicular section taken, in the direction of flow, and FIG. 6 showing a top view.
Figure 4:
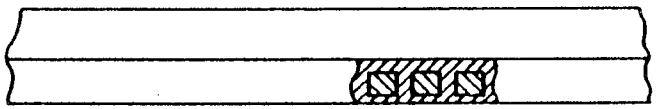

FIG. 3 shows that the expansion member 4 is formed of a plurality of cells 30, 31, 32, 33, 34, etc., each having a box shaped profile. Each individual cell is formed by its own walls. For simplicity, only the walls of the cell 31 have been provided with reference numbers. These are the two vertical side partition walls 31.1 and 31.2, which are perpendicular to the outlet slot and the two horizontal walls, which are parallel to the outlet slot, namely the upper transverse wall 31.3 and the lower transverse wall 31.4.

Figure 7:
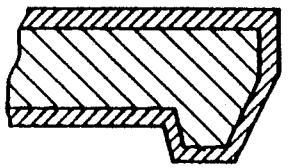
FIG. 7 is an enlarged showing of the tip portion of the upper lip shown in FIG. 5.
Figure 6:
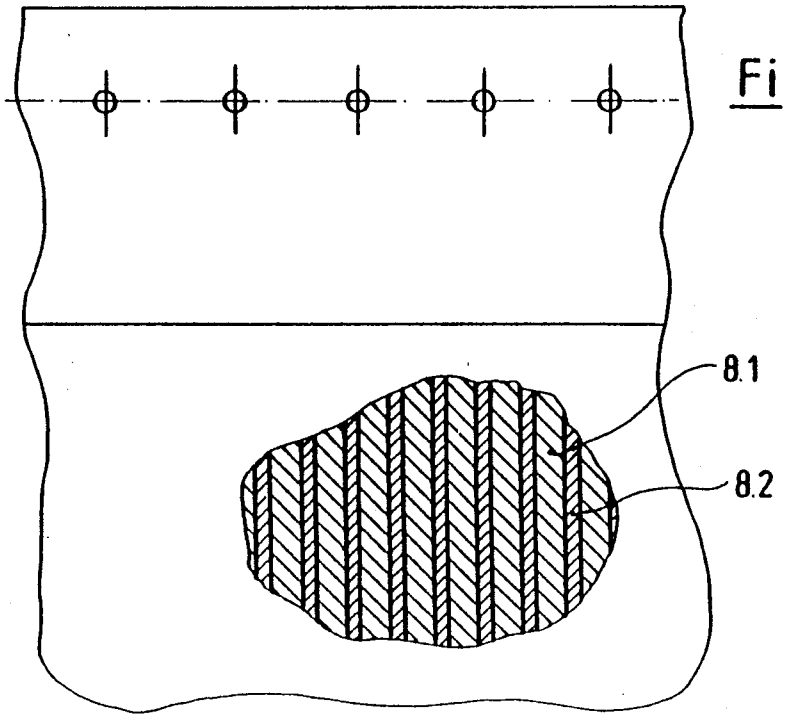

The upper lip 2 serves as the upper limitation of the flow channel 1. That lip has a tip portion shown in FIG. 7. Its downward extension provides for the throat of the flow channel, and has the effect of increasing the flow speed at the exit from the channel. The lip is formed of a plurality of individual ledges, including alternating wider ledges 8.1 and narrower ledges 8.2. Each wider ledge 8.1 extends substantially over the entire width in the flow direction of the lower transverse wall of the respective cell and particularly over the width of the lower transverse wall 31.4 of the cell 31. Each narrower ledge 8.2 underlies a respective region at which two adjacent partition walls of two adjacent cells abut. Both types of ledges, therefore the ledges 8.1 and the ledges 8.2, extend in the direction of flow over the entire width of the expansion member.

The wider ledges 8.1 between the partition walls of a cell are formed of relatively rigid material. On the other hand, the narrower ledges 8.2 which underlie the partition walls are formed of extremely stretchable material and thus have a very soft spring characteristic. For example, the relatively rigid material may be comprised of steel or carbon fibers while the more stretchable material may be comprised of rubber, polyethylene or epoxy resin.

According to another preferred feature, the material at least of the stretchable narrow ledges 8.2 is more stretchable in the cross machine direction, laterally in FIG. 3, and is stiffer and less stretchable along the machine direction, so that the below described stretching is at least mostly in the cross machine direction.

The material of the more stretchable partition walls may be the same as that of the more stretchable ledges of the transverse wall.

If more pressure is applied to one of the cells, for instance the cell 31, through its pressure connection 5, than to its neighboring cells, then the two vertical partition walls 31.1 and 31.2 are stretched outward. These two partition walls can slide on the adjacent partition walls of the neighboring cells 30 and 32. Upon the resultant lengthening of the partition walls 31.1 and 31.2, the corresponding wide ledge 8.1, which underlies and adjoins at the bottom the transverse wall 31.4 of the cell 31, is pushed downward. As a result of the great stretchability of the ledges 8.2, which stretch without significantly deflecting or stretching the vertical partition walls they underlie, there is almost no transfer of this downward movement of the one ledge 8.1 to the two adjacent wide ledges 8.1 at the lower transverse walls of the neighboring cells 30 and 32.

In the embodiment shown in FIGS. 4 to 7, stiffer ledges 8.1, e.g. rigid metal bars, are embedded in a continuous piece of highly stretchable material like that of above noted ledges 8.2, which produces a ledge 8.2 of highly stretchable material in each case between two adjacent stiff ledges 8.1. This avoids having the separate ledges 8.1 and 8.2 illustrated in FIG. 3, while achieving the same function.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a machine for manufacturing a paper web, an expansion member for use on the machine for manufacturing a paper web, the expansion member extending transversely across the width of the machine, the expansion member comprising:

the expansion member being subdivided into a plurality of cells arrayed across the width of the machine by upstanding partition walls located at each side of a cell and between each two of the cells, and the partition walls being highly stretchable;

each cell being further defined by transverse walls which extend transverse to the machine direction and extend between the partition walls and are spaced apart from each other, whereby each cell is surrounded by the respective partition walls and the transverse walls thereof;

means for substantially preventing movement of at least one transverse wall due to an increase in pressure in the corresponding cell from being transferred to an adjacent transverse wall at an adjacent cell, said means comprising at least one of the transverse walls of each cell being more stretchable in the region of the at least one transverse wall that is at the partition walls between that cell and neighboring cells, and the at least one transverse wall being less stretchable in its other regions not at said respective partition walls of that cell; and means communicating into the cell for selectively supplying pressure to the cell.

2. The expansion member of claim 1, wherein the respective partition walls and transverse walls together define each cell generally in the shape of a box.

3. The expansion member of claim 1, wherein each cell is comprises of its own respective partition and transverse walls, the partition wall between neighboring cells is comprises of the respective, contacting, neighboring partition walls of the neighboring cells, and the neighboring partition walls of the neighboring cells are structured and arranged for carrying out parallel displacements with respect to each other.

4. An expansion chamber and breast box outlet combination comprising:

the expansion chamber of claim 1;

the breast box comprising a pair of lips defining an outlet slot between the lips for outlet of suspension past the lips; the expansion chamber being supported at one of the lips and the one transverse wall being at the one lip for applying force to the one lip; the one lip being locally deflectable under the force applied thereto by the one transverse wall for locally deflecting the one lip in the region across the machine of the transverse wall which is deflected by pressurization of the respective cell.

5. The combination of claim 4, wherein the other lip of the breast box outlet slot is stiff.

6. In a machine for manufacturing a paper web, an expansion member for use on the machine for manufacturing a paper web, the expansion member extending transversely across the width of the machine, the expansion member comprising:

the expansion member being subdivided into a plurality of cells arrayed across the width of the machine by upstanding partition walls located at each side of a cell and between each two of the cells, and the partition walls being highly stretchable;

each cell being further defined by transverse walls which extend transverse to the machine direction and extend between the partition walls and are spaced apart from each other, whereby each cell is surrounded by the respective partition walls and the transverse walls thereof;

at least one of the transverse walls of each cell being more stretchable in the region of the at least one transverse wall that is at the partition walls between that cell and neighboring cells, and the at least one transverse wall being less stretchable in its other regions not at said respective partition walls of that cell, wherein the at least one transverse wall is comprised of a flexible wall which defines the cells and of a further wall outside of the flexible wall and in contact with the flexible wall, and the more stretchable and less stretchable regions of the one transverse wall are defined in the further wall; and means communicating into the cell for selectively supplying pressure to the cell.

7. The expansion member of claim 6, wherein the more stretchable and less stretchable regions respectively comprise more stretchable and less stretchable ledges that extend along the length in the machine direction of the partition walls.

8. The expansion member of claim 7, wherein the more stretchable and less stretchable ledges alternate across the machine direction.

9. The expansion member of claim 6, wherein each cell is comprised of its own respective ones of the partition walls and the transverse walls, the partition wall between neighboring cells is comprised of the respective, contacting, neighboring partition walls of the neighboring cells and the neighboring partition walls of the neighboring cells are structured and arranged for carrying out parallel displacements with respect to each other.

10. The expansion member of claim 9, wherein the further wall is a single wall comprised of the sections of highly stretchable material and the less stretchable regions.

11. The expansion member of claim 6, wherein the nonstretchable regions of the one transverse wall are substantially rigid.

12. The expansion member of claim 6, wherein at least the more stretchable regions of the further wall are comprises of a material which is of a different stretchability and stiffness in mutually perpendicular directions transverse to and along the machine direction, and that the more stretchable regions are arranged so that they are less stiff and more stretchable in the direction transverse to the machine direction and are stiffer and less stretchable in the machine direction.

13. An expansion chamber and breast box outlet slot combination comprising:

the expansion chamber of claim 6; the breast box comprising a pair of lips defining an outlet slot between the lips for outlet of suspension past the lips; the expansion chamber being supported at one of the lips and the further wall being at the one lip for applying force to the one lip; the one lip being locally deflectable under the force applied thereto by the further wall for locally deflecting the one lip in the region across the machine of the further wall which is deflected by pressurization of the respective cell.

14. The combination of claim 13, wherein the other lip of the breast box outlet slot is stiff.

15. In a machine for manufacturing a paper web, an expansion member for use on the machine for manufacturing a paper web, the expansion member extending transversely across the width of the machine, the expansion member comprising:

the expansion member being subdivided into a plurality of cells arrayed across the width of the machine by upstanding partition walls located at each side of a cell and between each two of the cells, and the partition walls being highly stretchable;

each cell being further defined by transverse walls which extend transverse to the machine direction and extend between the partition walls and are spaced apart from each other, whereby each cell is surrounded by the respective partition walls and the transverse wall thereof;

at least one of the transverse walls of each cell being more stretchable in the region of the at least one transverse wall that is at the partition walls between that cell and neighboring cells, and the at least one transverse wall being less stretchable in its other regions not at said respective partition walls of that cell, wherein the more stretchable and less stretchable regions respectively comprise more stretchable and less stretchable ledges that extend along the length in the machine direction of the partition walls; and means communicating into the cell for selectively supplying pressure to the cell.

16. The expansion member of claim 15, wherein the more stretchable and less stretchable ledges alternate across the machine direction.

17. In a machine for manufacturing a paper web, an expansion member for use on the machine for manufacturing a paper web, the expansion member extending transversely across the width of the machine, the expansion member comprising:

the expansion member being subdivided into a plurality of cells arrayed across the width of the machine by upstanding partition walls located at each side of a cell and between each two of the cells, and the partition walls being highly stretchable;

each cell being further defined by transverse walls which extend transverse to the machine direction and extend between the partition walls and are spaced apart from each other, whereby each cell is surrounded by the respective partition walls and the transverse walls thereof;

at least one of the transverse walls of each cell being more stretchable in the region of the at least one transverse wall that is at the partition walls between that cell and neighboring cells, and the at least one transverse wall being less stretchable in its other regions not at said respective partition walls of that cell, wherein at least the more stretchable regions of the one transition wall are comprised of a material which is of a different stretchability and stiffness in mutually perpendicular directions transverse to an along the machine direction, and that the more stretchable regions are arranged so that they are less stiff and more stretchable in the direction transverse to the machine direction and are stiffer and less stretchable in the machine direction; and means communicating into the cell for selectively supplying pressure to the cell.

* * * * *